US007780033B2

(12) United States Patent
Mansfield et al.

(10) Patent No.: US 7,780,033 B2
(45) Date of Patent: Aug. 24, 2010

(54) PLURAL CHAMBER DRINKING CUP

(75) Inventors: Bryan D. Mansfield, Bradenton, FL (US); Ricky R. Lambert, Bradenton, FL (US)

(73) Assignee: Hurricane Shooters, LLC, Sarasota, FL (US)

( * ) Notice: Subject to any disclaimer, the term of this patent is extended or adjusted under 35 U.S.C. 154(b) by 0 days.

(21) Appl. No.: 11/778,627

(22) Filed: Jul. 16, 2007

(65) Prior Publication Data

US 2008/0029518 A1 Feb. 7, 2008

Related U.S. Application Data

(63) Continuation of application No. 11/255,572, filed on Oct. 21, 2005, now Pat. No. 7,243,812.

(60) Provisional application No. 60/633,359, filed on Dec. 3, 2004, provisional application No. 60/634,953, filed on Dec. 10, 2004.

(51) Int. Cl.

| | |
|---|---|
| ***B65D 1/24*** | (2006.01) |
| ***B65D 1/36*** | (2006.01) |
| ***B65D 25/04*** | (2006.01) |
| ***B65D 57/00*** | (2006.01) |
| ***B65D 85/00*** | (2006.01) |

(52) U.S. Cl. ..... 220/501; 220/505; 220/506

(58) Field of Classification Search ..... 220/501, 220/505, 506; 206/520; 215/6

See application file for complete search history.

(56) References Cited

U.S. PATENT DOCUMENTS

| | | | | |
|---|---|---|---|---|
| 3,442,420 | A * | 5/1969 | Edwards | 206/520 |
| 3,784,052 | A * | 1/1974 | Edwards | 206/520 |
| 5,853,105 | A * | 12/1998 | Roman et al. | 220/575 |
| 5,975,333 | A | 11/1999 | Lee | |
| 6,354,456 | B2 | 3/2002 | Rapson | |

(Continued)

FOREIGN PATENT DOCUMENTS

| | | | |
|---|---|---|---|
| DE | 20111393 | U1 | 11/2002 |
| DE | 202005008500 | U1 | 11/2005 |
| FR | 270235 | A | 9/1994 |

OTHER PUBLICATIONS

Office Action + Supplementary European Search Report & Opinion, EPO Patent Application, EP05852809.2, Apr. 8, 2009, 6 pp.

(Continued)

*Primary Examiner*—Harry A Grosso
(74) *Attorney, Agent, or Firm*—Michele L. Mayberry; New River Valley IP Law

(57) ABSTRACT

The invention provides a drink mixing cup for fluids comprising an outer chamber having an outer rim disposed at its top and a chamber disposed inside the outer chamber having an inner rim disposed below the outer rim by an amount selected to optimize mixing fluids poured from said chambers when drunk by humans while not interfering with their noses. The design allows for nesting of cups to reduce storage space. Anti-nesting ribs prevent full nesting so that separation of cups is not difficult. When thin walls made from plastic are used and the inner chamber is elevated, the fluid in the inner chamber is thermally insulated. When inverted, the chamber below the inner chamber can serve as a drinking glass.

10 Claims, 6 Drawing Sheets

U.S. PATENT DOCUMENTS

| | | | | |
|---|---|---|---|---|
| 7,243,812 | B2 * | 7/2007 | Mansfield et al. | 220/501 |
| 2007/0119726 | A1 | 5/2007 | Willat et al. | |
| 2007/0199940 | A1 | 8/2007 | Skala | |

OTHER PUBLICATIONS

Claims, EPO Patent Application, EP05852809.2, Jun. 26, 2007, 2 pp.

Patrick McNaughton, "Declaration of," Case 2:07-cv-00273-CE, E.D. Tex, *McNaughton, Inc.* v. *Hurricane Shooters, LLC* Attachment 1 to motion, Document 38-2, filed Mar. 4, 2008, pp. 1-4.

McNaughton, Inc. "Beer, Wine and Spirits (advertisement)," Case 2:07-cv-00273-CE, E.D. Tex., *McNaughton, Inc.* v. *Hurricane Shooters, LLC* Attachment 2 to motion, Document 38-3, filed Mar. 4, 2008, pp. 1-2.

* cited by examiner

PLURAL CHAMBER DRINKING CUP

CROSS REFERENCE TO RELATED APPLICATIONS

This application is a continuation of U.S. non-provisional application Ser. No. 11/255,572, filed on Oct. 21, 2005, and published as publication no. US 2006/0021986 A1 on Feb. 2, 2006, now U.S. Pat. No. 7,243,812, issued on Jul. 17, 2007, which claimed priority from and incorporated by reference U.S. provisional application No. 60/633,359, filed on Dec. 3, 2004 and U.S. provisional application No. 60/634,953, filed on Dec. 10, 2004, and all of the above applications and the publication are incorporated herein by reference in their entirety.

TECHNICAL FIELD

The invention relates to drinking glasses, more particularly, drinking glasses used in serving mixed drinks in bars and restaurants.

BACKGROUND

For at least the last fifteen years, bars and restaurants have been serving mixed drinks without mixing the drink. That is, a generally ethyl alcohol containing fluid is poured into a container, e.g., a shot glass, that is physically located inside another container, e.g., a tumbler. The volume between the outside of the inner container and the inside of the outer container is generally filled with a non-alcoholic fluid. Patrons tip up the outer container, with the inner container initially resting on the bottom, to cause some mixing of the two fluids. Alcohol serving establishments have put much creative effort into different fluid combinations and container sizes. There does not seem to be a generic name for this mode of delivery but the terms "shooters" or "bombers" are sometimes used.

In spite of the great popularity, this mode of delivery has certain disadvantages. First, it can be hard to pour into the annular space between the inner and outer container. One method is to fill the outer container and inner container separately. However, this means the outer walls of the inner container are handled by the server and possibly set down on a table. When the inner container is placed in the outer container, any contamination will be transferred to the fluid in the outer container. Second, on the way from a pouring station to a patron, the inner container can possibly move around vigorously enough inside the outer container to cause premature mixing of the fluids. This can be reduced by making the inner container more massive. However, that can be a hazard to patrons while they are attempting to drink from the combination. In addition, heavy containers are harder to carry, both for serving persons and other personnel who must handle them. Third, the variety of possible containers available to be used allows for creativity, but does not yield uniformly consistent mixing results. Fourth, the two separate containers must be washed and stored separately. Reducing labor is always desirable. Also, in many bars, shelf space is in limited supply and a way of reducing the need for it would be very desirable.

The only mode of delivering two fluids known to the inventors that does not involve two separate cups uses a two chamber vessel shaped in the form of an hour glass with an open top. (As of this filing, it can be seen at www(dot)quaffer(dot)com.) Based on the website video, a non-alcoholic fluid chaser is poured into the bottom chamber. Then, by tilting the vessel sideways and pouring carefully, the top chamber is partially filled with an alcohol containing fluid. If successful, the drinking experience apparently consists of the alcoholic fluid followed by the non-alcoholic chaser. However, this does not provide the experience of the aforementioned shooter that consists of a continual flow of a mixture of the two fluids.

There must be hundreds of U.S. patents directed to beverage containers. Many of these contain two or more compartments. Many of those are essentially sealed storage containers to be opened at the point of use and poured into another vessel. Examples include U.S. Pat. No. 3,603,485 to Vivier, U.S. Pat. No. 4,410,085 to Beneziat et al., U.S. Pat. No. 4,762,224 to Hall, U.S. Pat. No. 5,215,214 to Lev et al., U.S. Pat. No. 6,059,443 to Casey, U.S. Pat. No. 6,363,978 to Castillo, and U.S. Pat. No. 6,814,990 to Zeng.

For example, the Lev et al. patent, titled "Multi-Compartment Liquid Storage Container," has the overall appearance of the well-known pull-tab aluminum beverage can. However, the inventor apparently did not contemplate drinking from it. It has a pull tab (12) disposed in a top wall (14). Removing the pull tab reveals an outer wall (15) of an inner storage container (16), illustrated as a cylinder running from top to bottom of the can. An outer storage container is defined by the annular space between the outer wall of the can (10) and inner wall (15). The patent states that once the pull tab is removed, the contents may be immediately poured (emphasis added) and mixed. Another embodiment adds a section (36) having perforations (38) to the top of the inner container and sealed from compartments below it by penetrable foil membranes (34). After removing the pull tab, the membranes can be pierced by a straw (39) and immediately poured and mixed, see col. 4, ll. 20-21. The purpose of the perforated section is to produce turbulence and improve mixing. Still another embodiment divides the container into two side-by-side halves (52) and (54) along a diagonal (56) and provides a pull-tab (12) for each half. In this case also, when the pull tabs are removed, the contents of compartments may be poured and mixed simultaneously. Because the mixing occurs after pouring into some other container, this patent did not and need not have disclosed mixing properties as fluids exited the container.

U.S. Pat. No. 6,502,712, issued to Weber-Unger for a "Drinking Vessel," discloses a wine-type glass having an outer drinking compartment (11) and an inner aroma compartment (21) in fluidic communication with the outer compartment via an aperture (25). The aroma compartment has a wall (24) that keeps fluid from spilling out of the aroma compartment when it is being drunk from the drinking compartment. The aperture is placed so that only enough of the fluid enters the aroma compartment to produce an aroma, but not so much as to spill over the wall. Though interesting, this is not suitable for dispensing mixed drinks.

U.S. Pat. No. 5,405,030, issued to Frazier for a "Dual-Compartment Drinking Cup" has a front compartment (48) from which fluid is drunk and a rear compartment (46) that acts as storage, see FIG. 1. The two compartments are separated by a planar divider (44) having notches (60) along the sides. As disclosed, "The purpose of angling divider (48) (sic 44) into its two parts (54) and (56) is to inhibit spillage across the top of the divider at high tile angle," see col. 2, ll. 49-51. The volume of the rear compartment appears to be about twice that of the front. In one mode of operation, the rear is filled while the front is empty. As the cup is tipped toward the front compartment, the fluid from the rear flows through the notches into the front compartment leaving the rear one half-full so that, it is explained, it is possible to make a philosophical point about half-full cups.

In another mode, explained briefly, the cup may be used in connection with in-situ mixing of two different liquids to be ingested simultaneously. Not much detail is given. It appears that there should be some mixing of fluids from the two compartments as the cup is tipped, but the mixing ratio could vary considerably. Also, based on the first mode of operation, half the rear compartment contents would remain after the front one was emptied. Neither of these is desirable for serving mixed drinks. Although one of the objectives was to make the cup from a single mold, the design is fairly complex and the mold may be expensive to make.

In spite of the large effort that has gone into designing beverage dispensers, for some time there has remained a need for a mixed drink dispenser suitable for use in bars and restaurants. Not only must the dispenser provide patrons with a drink that is mixed as it is consumed, but the article must be inexpensive and practical from the standpoint of the proprietor. Until this invention, such a dispenser has not been available.

SUMMARY

The invention provides a plural chambered cup for serving mixed drinks comprising an outer chamber having a bottom with an outer edge wherein the outer edge terminates in an upwardly extending outer chamber side wall that terminates in an uppermost outer chamber rim that forms the periphery of an open top and further comprising an inner chamber disposed within the outer chamber having an inner chamber side wall that extends upwardly from the outer chamber bottom and terminates in an uppermost inner chamber rim that forms the periphery of an open top and also has a bottom with an outer edge terminating in the upwardly extending inner chamber side wall, wherein the inner chamber rim is disposed a selected distance below the outer chamber rim. The distance is selected to optimize mixing of fluids as they are simultaneously poured out of the two chambers while minimizing interference with the noses of drinkers.

Preferably the selected distance is in the range of about the range of about 0 in. to 1 in, more preferably, about 5/16 in. (0.8 cm) to 11/16 in. (1.7 cm) and still more preferably about 11/16 in. (1.7 cm).

In one embodiment, the outer chamber has a liquid volume of about four ounces and the inner chamber has a liquid volume in the range of about one to one and one-half ounces.

In a further embodiment, the chamber rims are rotationally symmetric about substantially concentric axes.

In another embodiment, the cup has an outer surface outline and an inner surface outline, the outer chamber has an annularly configured bottom, and there is an additional outer chamber inner side wall extending upwardly from the outer chamber bottom inner edge to the inner chamber rim wherein the inner chamber rim is still disposed a selected distance below the outer chamber rim.

This embodiment can also include the variations as above for the first embodiment. In addition, by slanting the walls of the chambers, the cup outside surface outline can be selected to appreciably nest inside the cup inside surface outline so that cups can be conveniently stacked.

In a further embodiment, the inner chamber bottom can be elevated above the outer chamber bottom so that said inner chamber can be thermally insulated from a table.

The cups of this embodiment can be inverted and used as an inexpensive single chamber shot glass.

One aspect of the invention is an apparatus for manufacturing the cup described above using a manufacturing technique selected from injection molding, blow molding, and thermoforming.

Also disclosed is an apparatus for delivering mixed drinks in an eating or drinking establishment utilizing one or more cups having an outer chamber and an inner chamber and having a space below said inner chamber disposed inside said outer chamber as described above, for example, wherein the apparatus comprises a tray having a plurality of mandrels having a shape corresponding to the space below the cup inner chamber, whereby the cups can be mounted on the mandrels and prevented from sliding off said tray when tipped.

By way of example, the tray may have a circular outline with a mandrel in the center and a plurality of mandrels disposed circumferentially.

BRIEF DESCRIPTION OF THE DRAWINGS

These and other features, aspects, and advantages of the invention will become better understood after inspection of the following description, claims, and appended drawings where:

DETAILED DESCRIPTION

Figure 1A:
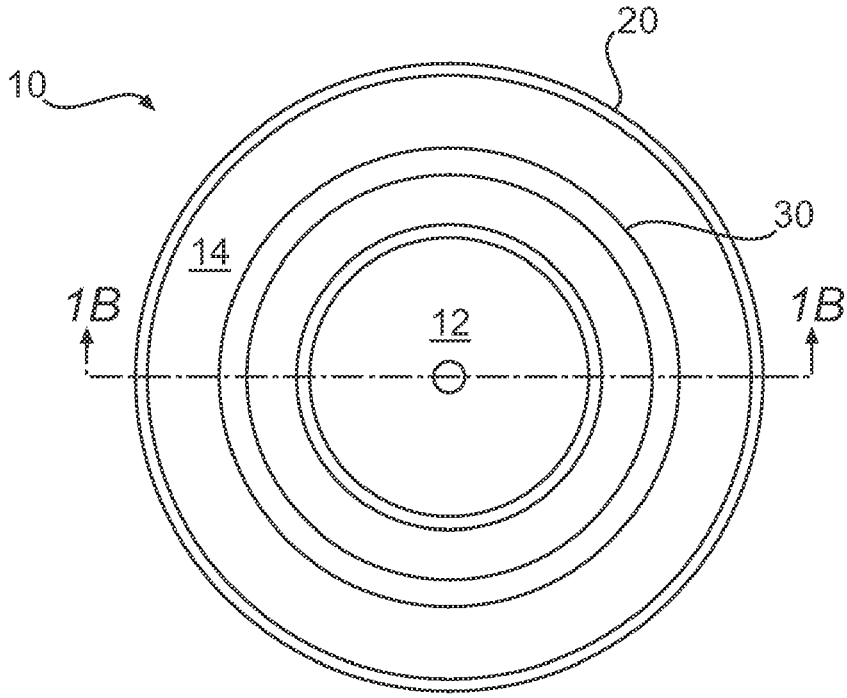
FIG. 1A illustrates a top plan view of a plural chamber drink mixing cup.

The invention will now be described with reference to the drawings. FIG. 1A shows a top plan view of the invented plural chamber drink mixing cup 10 having an inner chamber 12 with a top rim 30 and an outer chamber 14 with a top rim 20. (Herein, "top" and "bottom" refer to the usual orientations when drinking cups are used.)

Figure 1B:
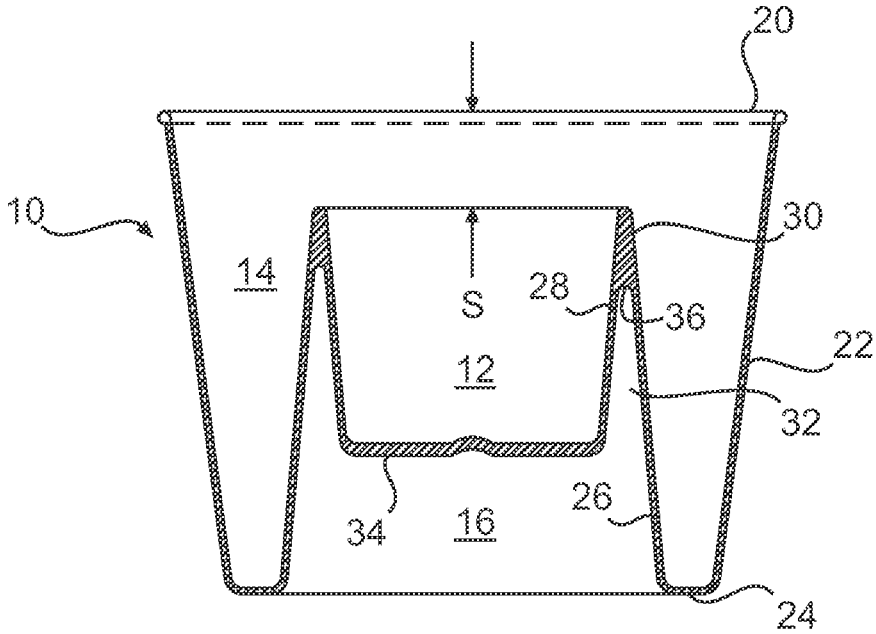
FIG. 1B illustrates a cross-section 1B-1B of the cup shown in FIG. 1A.

FIG. 1B shows cross-section 1B-1B of the cup having an inner chamber 12 with top rim 30 and an outer chamber 14 with top rim 20 as in FIG. 1A. Below chamber 12 is a chamber 16 that is not used to contain any fluids when the cup is upright. The outer rim or lip 20 can be used for drinking. Chamber 14 outer side wall 22 extends from rim 20 to the cup bottom surface 24 while chamber 14 inner side wall 26 extends up inside from bottom 24 to chamber 12 rim 30. Normally, unless picked up, the cup rests on bottom surface 24. As illustrated, this bottom surface 24 has the shape of an annulus. The structure 26 forms a fluid seal with the bottom 24 for the outer chamber 12.

Wall 28 of chamber 12 extends from rim 30 to bottom 34 of chamber 12 forming a notch 32 between walls 26 and 28. The distance from the top of rim 20 to the top of rim 30 is indicated by an S whose significance will be explained further below.

Preferably, the outline of the outside of the cup 10 substantially matches the outline of the inside of the cup. This makes it possible to nest cups and save on storage space. However, if there is an exact match, it was found that separating cups can be difficult due to an attraction between cups. Picking up one cup quickly sucked up additional cups as a vacuum piston might. The rib 36 extending below rim 30 between walls 26 and 28 in the notch 32 prevents the apex of the rim 30 from being inserted all the way into the notch 32 of another cup. Preferably, there should be at least three ribs equally spaced around the circumference of the notch 32.

It is well know that, for consumer items, injection molded plastic parts can be made with lesser production costs than many other methods. Typically, a cavity inside a mold having two dies is injected with hot plastic that is allowed to cool and the two dies are pulled apart to let the plastic part fall out. This is not possible for all designs. As is very well known, the dies must define a plane (or planes) through the part that, when viewing the part perpendicularly away from the plane in both directions, no overhanging structure is encountered. The perimeter of such a plane is defined as a parting line. When a cross section of the part is viewed edge-on to the parting line, it forms a single straight line from one extreme edge of the cross-section to the other with no overhangs or undercuts perpendicular to the parting line on either side of it. For any given cross section, CAD/CAM software is available to determine a parting line, if one exists. Thus, a parting line is a geometric construct that limits the design of the part.

The cup illustrated in FIG. 1B has a parting line that runs across the top tangent to the rim 20. This makes it possible to use injection molded plastic construction.

Several different cups were constructed for testing. To get a general sense of the sizes, by way of a first example only, a typical volume might be about 1.3 oz. (38 ml) for the inner chamber 12 and about 4.1 oz. (121 ml) for the outer chamber 14. These volumes allow for filling to an informal industry standard of 1.25 oz. (37 ml) for the inner chamber and 4.0 oz. (118 ml) for the outer without filling to the top of the inner rim 30. In this example, the overall diameter across the top was about 3.25 in. (8.3 cm) and had a height of about 2.5 in. (6.4 cm). The overall diameter of the inner chamber was about 1.5 in. (3.8 cm). It should be straightforward to obtain any desired volume by varying the dimensions. The distance S was about 5/16 in. (0.8 cm). Changing the distance S from the top of rim 20 to the top of rim 30 will change both inner chamber 12 and outer chamber 14 volume, but this has a greater significance as discussed below.

A second typical example had a volume of about 1.15 oz. (34 ml) for the inner chamber 12 (to accommodate a shot glass of 1 oz. (30 ml)) and about 4.0 oz. (118 ml) for the outer chamber 14 (to provide an apparently desirable 4:1 ratio.) These volumes were obtained for a cup with an overall diameter across the top also of about 3.25 in. (8.3 cm), but a height of about 2.7 in. (6.9 cm). The overall diameter of the inner chamber 12 in this example was about 1.7 in. (4.3 cm). The distance S was about 11/16 in. (1.7 cm).

Walls 22, 26, and 28 had approximately equal slopes with respect to a vertical of about 7°. As is well know in the injection molding arts, this is also the draft angle. Advantageously, when drinking from the cup, fluids flow down the slopes in chamber 12 and 14 even when the cup is horizontal; i.e., the cup does not have to be tipped up to empty it.

By way of example only, when made from plastic, typical dimensions for the thickness of walls 22, 26, and 28 were in the range of 0.03-0.05 in. (0.76-1.3 mm) and the thickness of the bottom 34 was in the range of 0.06-0.08 in. (1.5-2.0 mm). When made using injection molded plastics, there are additional non-essential artifacts not shown. The weight of a typical example was about 0.8 oz (25 g). When made from glass, the thickness of walls 22, 26, and 28 would usually be more than that shown or indicated and the weight of the cup much greater. The cup could be made from a variety of materials as this is not critical in some applications.

When made from injection molded plastic, two materials can be considered. So-called crystal polystyrene is inexpensive and easy to work, but not as durable as polycarbonate. This art is fairly well developed and making the cup should present no difficulty to anyone with ordinary skill in it.

Mixing and Pouring Experiments:

Several examples were made with the same general dimensions except that the distance S between the top of inner chamber 30 and the top of the outer chamber 20 as shown in FIG. 1A, was varied. The examples were made with crystal polystyrene, but it is believed similar results would be obtained with other materials.

Experiments were undertaken with a jig that could hold the cups and tip them from vertical to horizontal over a controllable time period. Two seconds was picked as being representative of actual use. The tipping was by gravity and could be stopped in the middle as well. The outer chamber was filled with clear water and the inner with water to which food coloring had been added. Filling was to within about 1/8 in. (0.3 cm) from the top of the respective rim 30. In some experiments, an upper lip was simulated with a tape across the rim 20 acting as a dam that left a 1/8 in. (0.3 cm) gap between the tape and rim at its widest.

Figure 2A:
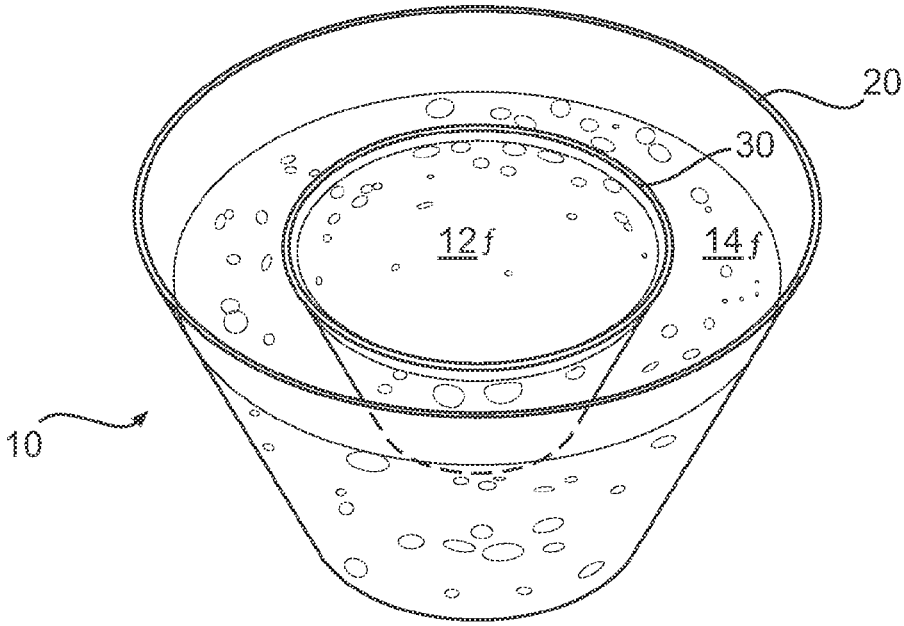
FIG. 2A shows a schematic illustration of a cup filled with two fluids.

FIG. 2A shows a cup 10 filled with fluid 12*f* and 14*f* in their respective chambers almost to the rim 30. Since the aim is to avoid mixing fluids before drinking, filling should be below the rim 30 in both chambers.

Figure 2B:
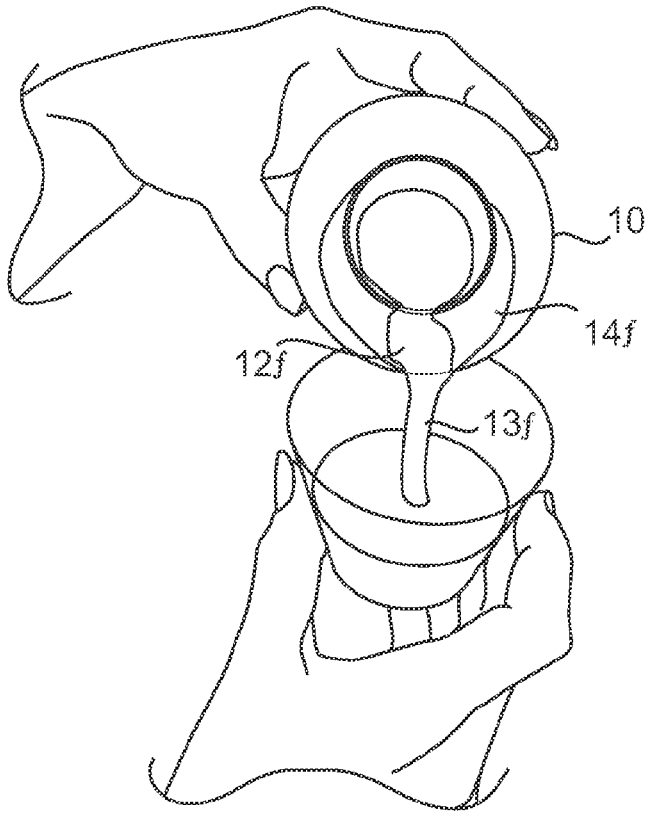
FIG. 2B shows a schematic illustration of the cup shown in FIG. 2A being poured out into a normal cup.

FIG. 2B illustrates tipping the cup 10 so that fluid 12*f* pours out and mixes with fluid 14*f* to form a mixed fluid 13*f*. This is the case when no tape dam was used. It is difficult to illustrate, but the fluid 12*f* starts out on top of fluid 14*f* and sinks into it toward the edge of the cup. Fluid 12*f* can meander a bit, depending on how fast it is flowing. Note that, in normal use, fluids will not be poured from the cup 10; patrons will be drinking from the rim 20.

Figure 3A:
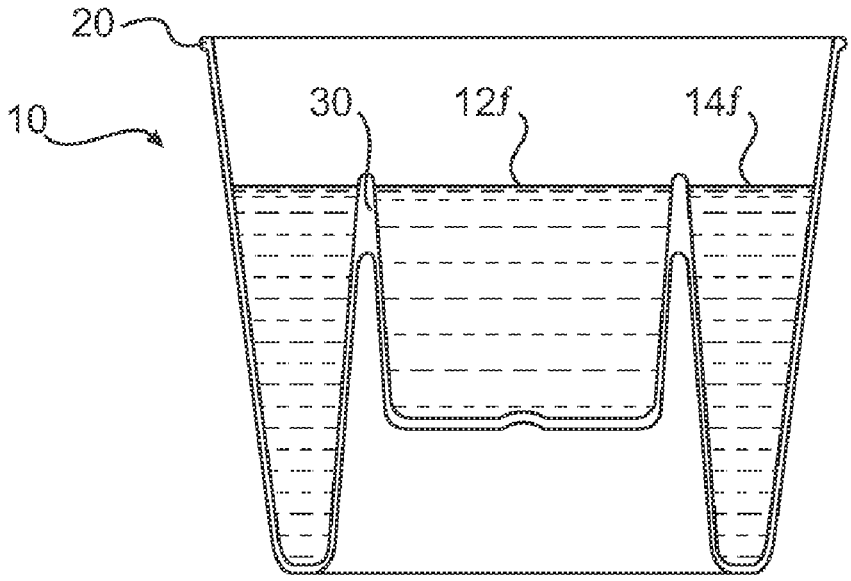
FIG. 3A shows a cross-section of a plural chamber drink mixing cup filled with two fluids.
Figure 3B:
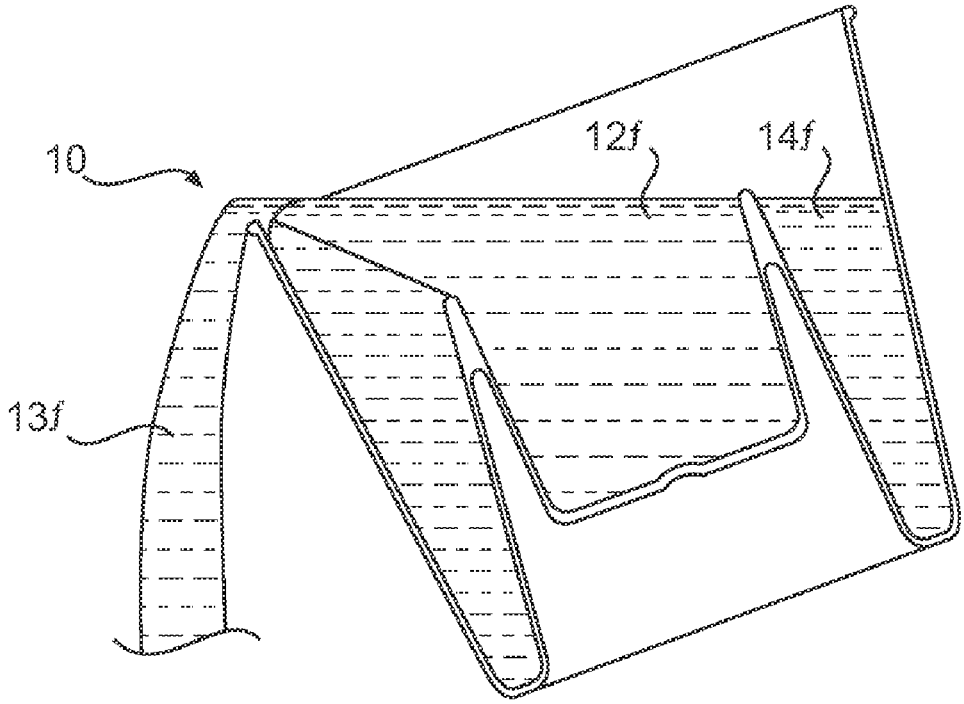
FIG. 3B shows a cross-section of the cup in FIG. 3A being poured at a small angle.
Figure 3C:
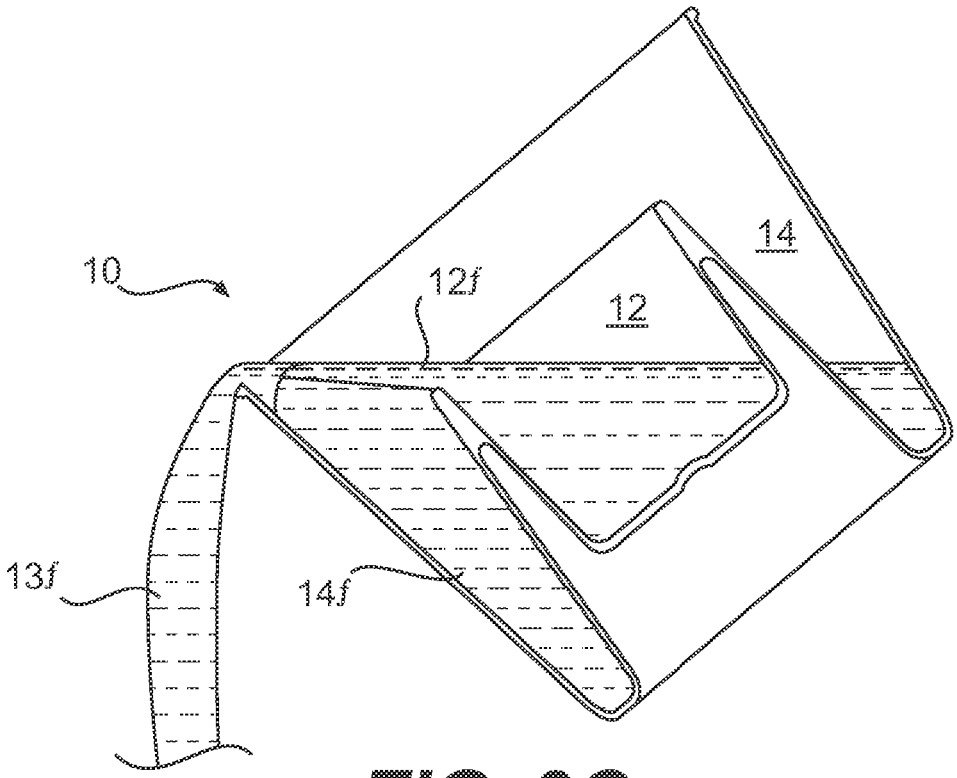
FIG. 3C shows a cross-section of the cup in FIG. 3A being poured at a larger angle than in FIG. 3B.
Figure 3D:
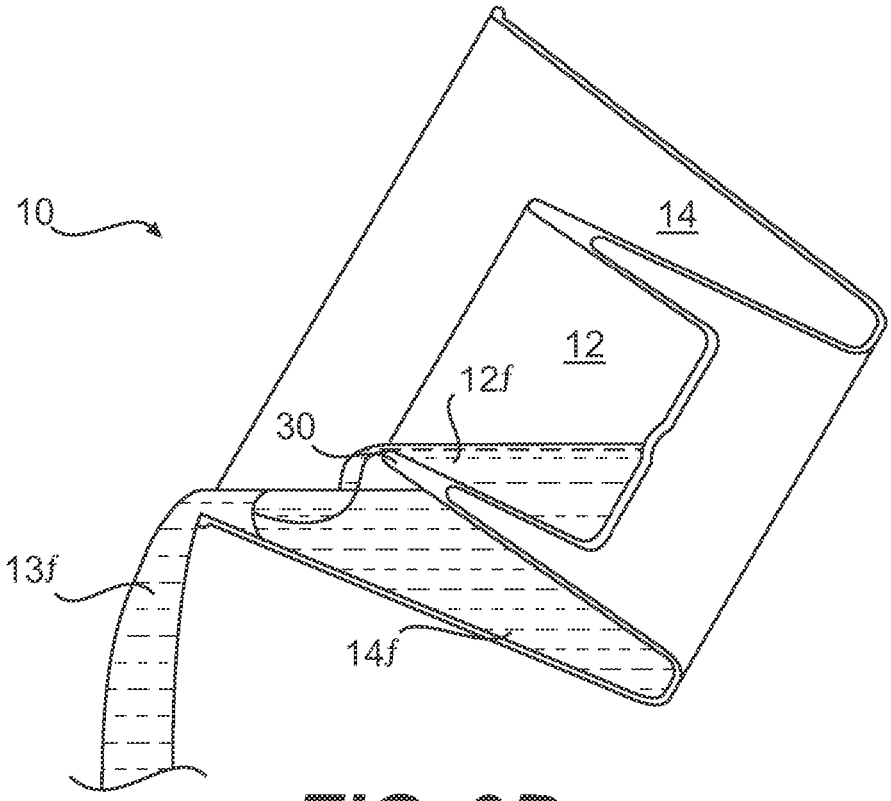
FIG. 3D shows a cross-section of the cup in FIG. 3A being poured at a larger angle than in FIG. 3C.

FIGS. 3A-3D illustrate in cross-section a sequence of pouring fluids from the cup. It should be noted that these figures illustrate the qualitative aspect of mixing fluids; they are not intended to be precise. In FIG. 3A, the cup 10 is filled with fluids 12*f* and 14*f* almost to the top of rim 30. In FIG. 3B, the cup is tipped slightly so the fluids mix and form fluid 13*f*. This cross section is in the center of the cup. Thus, it does not show fluid 14*f* flowing around and coming under 12*f* as suggested in FIG. 2*b*. FIGS. 3C and 3D show progressively further tipping. Again, this is not an illustration of a person actually drinking from the cup. In normal use, drinking from the cup will form a partial dam where the fluid 13*f* is coming out. This was partially simulated with the tape noted above. Several experiments were conducted.

The first experiment was with S=0. This cup was constructed using two separate plastic cups, one glued inside the other, with their top rims at the same height. Thus, the inner and upper chamber fluids 12*f* and 14*f* were at the same level. It was expected that this simple design would work well.

However, during a tip run, it was observed that the outer chamber fluid 14*f* exited the cup first, followed by the inner chamber fluid 12*f*. When the inner chamber top 20 was used as a convenient fill line, fluid in the outer chambers was near the top of the cup and splashing outside the cup was difficult to prevent.

With S=⅝ in. (1.6 cm), the inner chamber top was below the outer chamber top. Splashing was not at all a problem but, as will be explained, there were others. As the inner chamber height is reduced, it and the outer chamber diameter must be increased to maintain the same volume. This could be overcome by changing the height of the overall cup. Still, the outer chamber must be filled through an annulus around the inner chamber. With this deeper inside the cup, more care was required than with S=0. A little extra care was also required in filling the inner chamber, as well. Mixing was not bad, but whenever pouring was stopped half way, the outer chamber fluid tended to splash back into the inner chamber.

The optimum distance of the inner chamber below the outer chamber appeared to occur with about S=5/16 in. (0.79 cm). In that case filling was not too difficult. The inner and outer chamber could be filled to the top of the inner chamber without danger of splashing outside the cup during transport. On pouring, mixing was good but backsplash into the inner chamber when stopped before completion was not great. Thus, consumption could be stopped in the middle and restarted with similar mixing results.

Since the objective is to produce a pleasing taste experience, tests were performed on all three examples using carbonated water in the outer chamber and Cherry Coke® syrup in the inner chamber. In this case, the cup was emptied by hand. With S=0, the carbonated water taste came through first, followed by the syrup. With S=5/16 in. (0.8 cm), the taste sensation was that of a typical soda fountain Cherry Coke®. A similar result was produced with S=⅝ in. (1.6 cm), but setting the cup down before draining the fluids produced a backsplash of carbonated water into the inner chamber. Premature mixing is considered a drawback when used with alcoholic beverages.

For field trials, cups with S=5/16 in. (0.8 cm) were taken to an alcohol serving establishment owned by one of the inventors. When tried by patrons, this value of S was found to be unsatisfactory for some of them. Since they were used to the traditional method, they tended to guard their teeth against an imagined movable shot glass with their upper lip, essentially, sipping from the outer chamber 14. With a lip protruding into the outer chamber almost to the inner chamber 12, the expected mixing did not occur as it had when liquids were poured by hand (as illustrated in FIG. 2B). Also, there was some spillage as fluid from the inner chamber flowed over the upper lip of a patron.

To solve this problem, more cups were made, but with S=½ in. (1.3 cm). Lowering the rim of the inner chamber removed it enough from lips to make mixing possible and prevent spillage. This is believed to be the optimum for most patrons. However, in a second set of field trials in the same establishment, some patrons found that the distance was not enough to prevent interference with their nose. Therefore, as of the filing date, in production, S=11/16 in. (1.7 cm) with the dimension as given above for the second typical example.

The invention has various other advantages over what is currently available. An example of a non-obvious one is the following. The fluid in a shot glass surrounded by a fluid is not well insulated by the shot glass wall. Some mixed drinks use fluids at different temperatures that should be maintained between pouring and consumption. The current invention can be made with thin walls of plastic that is a relatively poor heat conductor. The air space 16 below the chamber 12 acts as a good insulator against the environment and is insulated from the outer chamber 14 as well. Thus, the temperature differential can be maintained for some time.

A major advantage to the unitary construction is that there is no inner cup moving against a patron's teeth. This construction also reduces handling and cleaning labor. Injection molding could be used to produce two chambers that are then snapped together, but this adds a labor cost that might outweigh the saving in mold design. In fact, some establishments have found the cost of the production cups described herein low enough to make it cost effective not to wash them at all. Although the inventors prefer injection molding, consideration should be given to thermoforming as a construction method. It is believed that this would produce a less expensive, but less durable and attractive cup.

Figure 5:
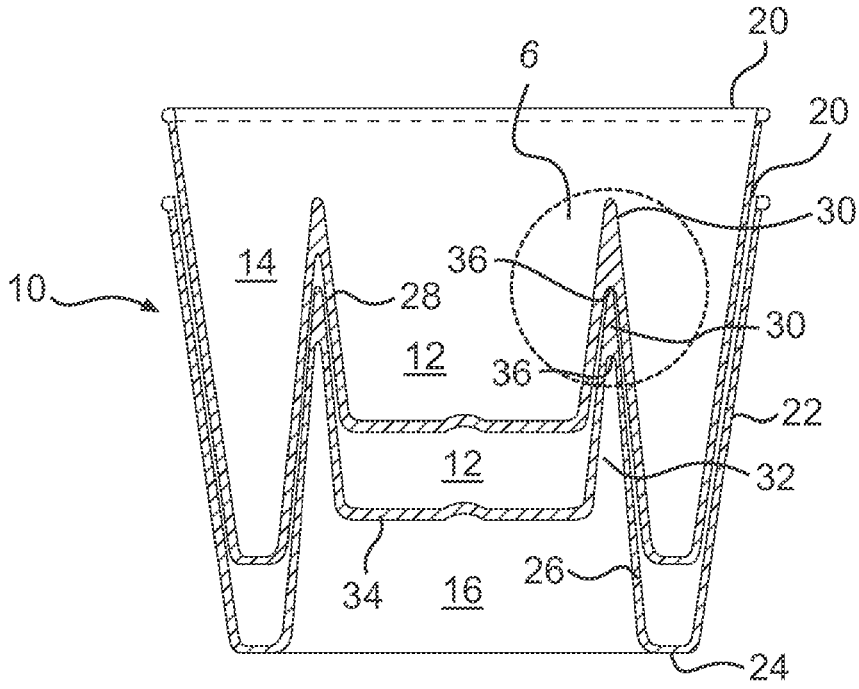
FIG. 5 illustrates two cups with the cross-section shown in FIG. 1B in a nested relationship.
Figure 6:
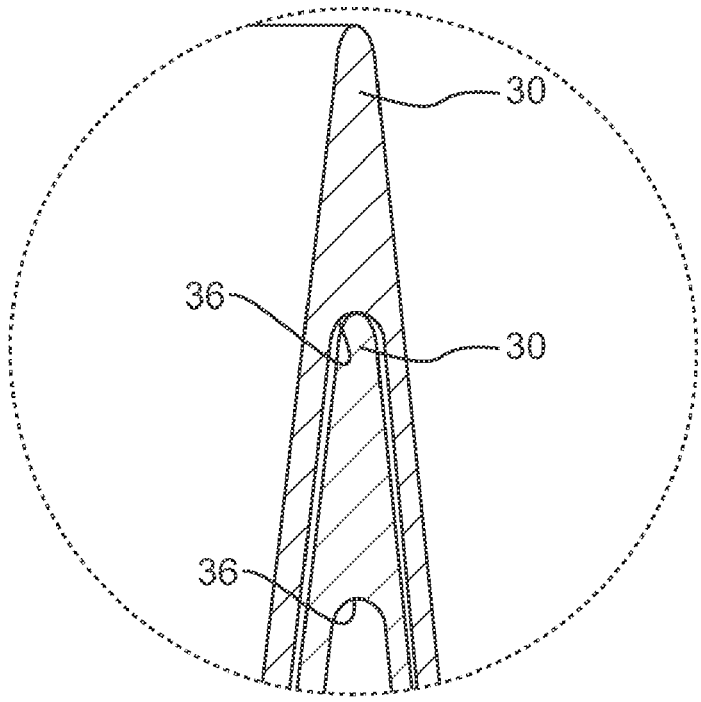
FIG. 6 illustrates the enlargement 6 in FIG. 5.

Although possibly not essential, the substantially matching top and bottom outlines mean that cups can be stacked as illustrated in FIG. 5. This reduces storage space requirements. FIG. 6 illustrates an enlarged view of the interface between the top of the rim 30 and downward projecting ribs 36. The function of the ribs 36 to space apart nested cups can be provided with protrusions in a variety of places on the cup.

Figure 4A:
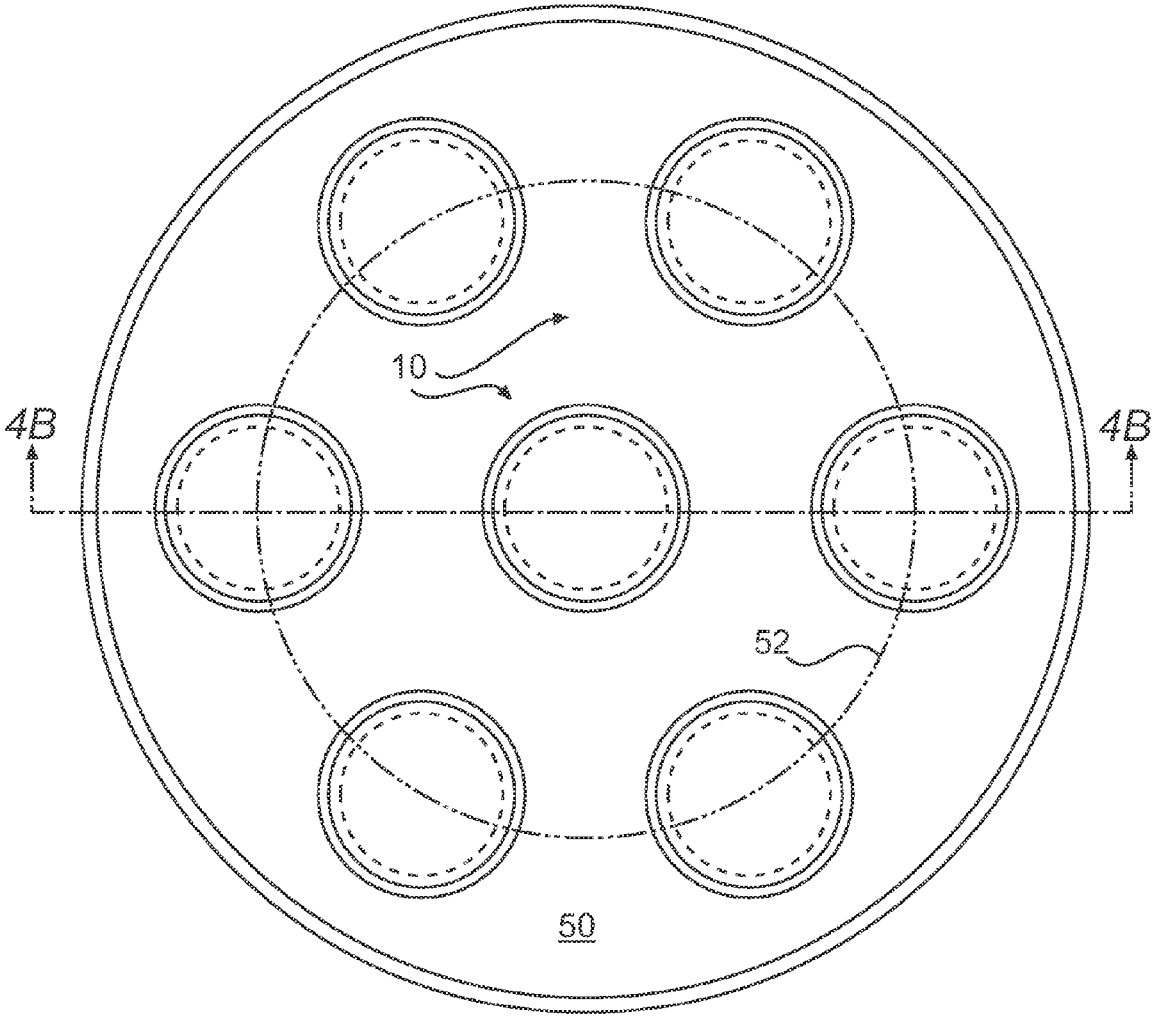
FIG. 4A illustrates a top plan view of a serving tray for one or more of the plural chamber drink mixing cups illustrated in FIGS. 1A, 1B, 2A, 2B, 3A, 3B, 3C, & 3D.
Figure 4B:
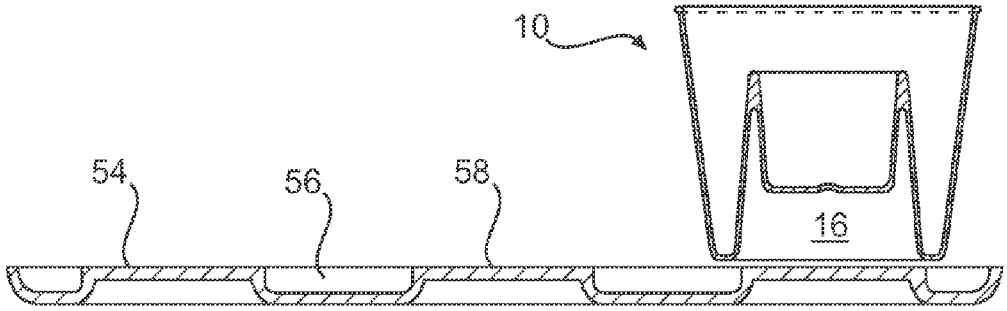
FIG. 4B illustrates a side view cross-section of the serving tray illustrated in FIG. 4A.

Another major advantage has to do with the difficulty that serving persons have in carrying drinks to patrons in crowded bars. When trays are used, as is often the case, there is always a chance of tipping the serving containers off the tray and losing the drink or worse, drenching a patron. FIGS. 4A & 4B illustrate a solution to this problem that may be unique to this cup design. As show in FIG. 4A, a tray 50 is provided that can securely transport one or more cups 10. In the figure, there is one cup in the center and six disposed on a circle 52, but the layout is not critical. FIG. 4B shows a cross-section with mandrels 54 and 58 disposed around the base of the tray 50. As can be seen, the mandrels are shaped to match the inside space 16 of cup 10. Higher mandrels could be used, if necessary. Tipping may cause mixing of the inner and outer chambers, but at least patrons will not get wet.

As may be appreciated, if the cup illustrated in FIG. 1B is inverted, the space 16 can now be filled with liquid. In this orientation, the cup can be used as an inexpensive single chamber shot glass. As may be further appreciated from FIG. 1B, another inexpensive single chamber shot glass can be formed with chamber 12, rim 30, and sidewall 26 separated from bottom 24 as a standalone article. The bottom of sidewall 26 could simply be truncated or terminated in a rolled rim or some other ending.

Having described the best modes of the invention, several variations can be mentioned. First, the slope of the walls need not be 7°. When made with injection molded plastic, draft angles as little as 3°, even 0.5°, can be used. On the other hand, a larger slope would mean the cup would need less tipping to empty the fluids. That would mean that the distance S could be reduced without causing interference with the noses of patrons. However, slopes larger than 7° could be clumsy to handle and may present balance problems. Assuming thin walls, nesting can still be accomplished, even if the walls 22, 26 and 28 each have different slopes.

Second, the cup need not be circular. For example, matching polygons could be used for the two chambers. Many-sided polygons would probably have similar mixing characteristics as a circle. A square, however, might be difficult to drink from and would have different optimum values of S. With these variations, the bottom surface 24 would be annular-like, but not a formal geometric annulus. In general, a high degree of rotational symmetry makes it possible to fill and drink from any orientation. If, in addition, the vertical axes of the two chambers, 12 and 14, are concentric, then mixing properties will be the same from any orientation, also.

Third, however, the cup need not be highly symmetric. As an extreme example, the cup chambers could be D-shaped. To obtain the same volume, the heights and/or diameters would have to be increased. However, the result would probably look too unstable and S would have to be adjusted.

Fourth, the chambers need not be completely open. Some sort of partial cover could be used as long as the cup was accessible to pourers and drinkers. Injection molding and nesting the cups would be difficult, however.

With respect to nesting, the cups illustrated herein nest up to a little over 80%, i.e., 20% of a one cup protrudes from the cup below. However, it is not necessary to have this much nesting to be useful. Any appreciable nesting, for example, 30% would save some space and make stacking possible, although at least 50% would be more desirable.

Fifth, the volumes could be increased by scaling up the dimensions. The optimum value of S for mixing should also scale. However, at S=1 in (2.5 cm), the inner cup may starts to be too far below the outer rim to be easily poured into. Also, the overall diameter may become too large to comfortably handle.

Lastly, the same principles disclosed herein could be used to add a chamber between the inner chamber 14 and outer chamber 12 to make a cup with three chambers on the top. To maintain volumes, the overall diameter of the cup might become large, but it could be used for novelty drinks. Another novelty cup could be made by sloping the rims 20 and 30. If rim 30 were sloped, then the distance S would be variable. Filling would be limited by the lowest point on the rim, but one could drink from different directions to vary the mixing properties.

Having described the general design and the heretofore unrecognized importance of adjusting the relative height S of the inner and outer chambers, it should only require routine experimentation for those with ordinary skill in the art to find different optimum values for different volumes. There may be a tradeoff between optimum mixing and avoiding interference with the noses of patrons but, with the guidance herein, it can now be made without undue effort.

What is claimed is:

1. A plural chamber drinking cup comprising:

a) an inner chamber with a bottom, a side wall, and a rim;

b) an outer chamber with a bottom, an inner side wall, an outer side wall, and a rim;

c) a lower chamber with a first side wall that is the outer chamber inner side wall and with a second side wall that is the inner chamber side wall;

wherein, when the cup is in an upright position, the inner chamber rim is surrounded by the outer chamber and is disposed below the outer chamber rim;

wherein the inner and outer chambers are capable of nesting at least about 75% based on height respectively within an inner chamber and an outer chamber of a second said cup when said cups are stacked; and wherein, along a vertical cross section of the cup cut in half, the inner chamber bottom and the inner chamber side wall together have matching interior and exterior surface outlines and the outer chamber bottom and the outer chamber side walls together have matching interior and exterior surface outlines to facilitate appreciable nesting.

2. The cup of claim 1 adapted to provide an anti-nesting function.

3. The cup of claim 1 wherein said inner chamber rim has a rounded profile.

4. A plural chamber drinking cup comprising:

a) an inner chamber, an outer chamber, and a lower chamber configured to allow for appreciable nesting;

b) wherein, when the cup is in an upright position, the inner chamber is surrounded by the outer chamber and the inner chamber at its rim is disposed below the outer chamber at its rim;

c) and wherein the inner and outer chambers are capable of nesting at least about 75% based on height respectively within an inner chamber and an outer chamber of a second said cup when said cups are stacked.

5. A plural chambered cup for serving mixed drinks having an outer surface outline and an inner surface outline comprising:

a) an outer chamber having an annularly configured bottom having an outer edge and an inner edge, said outer edge terminating in an upwardly extending outer side wall terminating in an uppermost outer chamber rim that forms the periphery of an open top;

b) an inner chamber disposed within said outer chamber having a continuous bottom having an outer edge terminating in an upwardly extending outer side wall terminating in an uppermost inner chamber rim that forms the periphery of an open top;

c) an outer chamber inner side wall extending upwardly from said outer chamber bottom inner edge to said inner chamber rim so that said inner chamber rim is disposed a selected distance below said outer chamber rim;

d) wherein said outer chamber inner side wall, said inner chamber outer side wall, and said inner chamber bottom form a lower chamber and wherein the inner chamber has a volume of about one to one and one half ounce and the lower chamber has a volume of about one to one and one half ounce; and e) wherein when stacked with a second said cup a gap between outer chamber rims is less than about 20% of cup height.

6. A plural chambered cup for serving mixed drinks having an outer surface outline and an inner surface outline comprising:

a) an outer chamber having an annularly configured bottom having an outer edge and an inner edge, said outer edge terminating in an upwardly extending outer side wall terminating in an uppermost outer chamber rim that forms the periphery of an open top;

b) an inner chamber disposed within said outer chamber having a continuous bottom having an outer edge terminating in an upwardly extending outer side wall terminating in an uppermost inner chamber rim that forms the periphery of an open top;

c) an outer chamber inner side wall extending upwardly from said outer chamber bottom inner edge to said inner chamber rim so that said inner chamber rim is disposed a selected distance below said outer chamber rim;

d) wherein said outer chamber inner side wall, said inner chamber outer side wall, and said inner chamber bottom form a lower chamber and wherein the inner chamber has a volume and the lower chamber has a volume which are the same or differ up to 50% based on volume; and e) wherein when stacked with a second said cup a gap between inner chamber rims is less than about 25% of inner chamber height.

7. The cup of claim 6, wherein the inner chamber has a volume and the lower chamber has a volume which are the same or differ up to 33% based on volume.

8. A plural chambered cup for serving mixed drinks having an outer surface outline and an inner surface outline comprising:

a) an outer chamber having an annularly configured bottom having an outer edge and an inner edge, said outer edge terminating in an upwardly extending outer side wall terminating in an uppermost outer chamber rim that forms the periphery of an open top;

b) an inner chamber disposed within said outer chamber having a continuous bottom having an outer edge terminating in an upwardly extending outer side wall terminating in an uppermost inner chamber rim that forms the periphery of an open top;

c) an outer chamber inner side wall extending upwardly from said outer chamber bottom inner edge to said inner chamber rim so that said inner chamber rim is disposed a selected distance below said outer chamber rim; and d) wherein said outer chamber inner side wall, said inner chamber outer side wall, and said inner chamber bottom form a lower chamber and wherein the inner chamber has a volume of about three quarters ounce to one and one half ounce and the lower chamber has a volume of about three quarters ounce to one and one half ounce;

e) and wherein when stacked with a second said cup a gap between outer chamber rims is less than about 20% of cup height.

9. The cup of claim 8, wherein when stacked with a second said cup a gap between inner chamber rims is less than about 25% of inner chamber height.

10. A plural chambered cup for serving mixed drinks having an outer surface outline and an inner surface outline comprising:

a) an outer chamber having an annularly configured bottom having an outer edge and an inner edge, said outer edge terminating in an upwardly extending outer side wall terminating in an uppermost outer chamber rim that forms the periphery of an open top;

b) an inner chamber disposed within said outer chamber having a continuous bottom having an outer edge terminating in an upwardly extending outer side wall terminating in an uppermost inner chamber rim that forms the periphery of an open top;

c) an outer chamber inner side wall extending upwardly from said outer chamber bottom inner edge to said inner chamber rim so that said inner chamber rim is disposed a selected distance below said outer chamber rim; and d) wherein said outer chamber inner side wall, said inner chamber outer side wall, and said inner chamber bottom form a lower chamber configured to allow for appreciable nesting and when stacked with a second said cup the inner chambers are capable of nesting at least about 75% based on height.

* * * * *